US008729992B2

(12) United States Patent
Schiepp et al.

(10) Patent No.: US 8,729,992 B2
(45) Date of Patent: May 20, 2014

(54) ELECTROMAGNETIC ACTUATOR DEVICE

(75) Inventors: Thomas Schiepp, Seitingen-Oberflacht (DE); Oliver Thode, Bodman-Ludwigshafen (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 13/131,080

(22) PCT Filed: Nov. 25, 2009

(86) PCT No.: PCT/EP2009/008371

§ 371 (c)(1),
(2), (4) Date: Jul. 2, 2011

(87) PCT Pub. No.: WO2010/063394

PCT Pub. Date: Jun. 10, 2010

(65) Prior Publication Data

US 2011/0267159 A1 Nov. 3, 2011

(30) Foreign Application Priority Data

Dec. 3, 2008 (DE) ..... 20 2008 015 980 U

(51) Int. Cl.
*H01F 7/00* (2006.01)
*H01F 7/16* (2006.01)

(52) U.S. Cl.
CPC ..... *H01F 7/1646* (2013.01); *H01F 7/1638* (2013.01)
USPC ..... 335/229; 335/230; 335/232; 335/234; 335/236; 335/259; 335/265; 335/267; 335/279; 335/281

(58) Field of Classification Search
USPC ..... 335/229–236, 256, 259, 265–267, 242, 335/279, 281, 296–297
See application file for complete search history.

(56) References Cited

U.S. PATENT DOCUMENTS

| | | | | | |
|---|---|---|---|---|---|
| 1,959,562 | A | * | 5/1934 | Ashworth | 335/232 |
| 2,144,543 | A | * | 1/1939 | Mishelevich | 335/92 |
| 2,613,254 | A | * | 10/1952 | King | 361/195 |
| 3,413,580 | A | * | 11/1968 | Gibas | 335/279 |
| 4,236,132 | A | * | 11/1980 | Zissimopoulos | 335/271 |
| 4,779,582 | A | | 10/1988 | Lequesne | |
| 4,782,315 | A | * | 11/1988 | Bataille et al. | 335/234 |
| 6,124,771 | A | * | 9/2000 | Kim et al. | 335/4 |
| 6,414,577 | B1 | * | 7/2002 | Hoffman | 335/229 |

(Continued)

FOREIGN PATENT DOCUMENTS

| | | | |
|---|---|---|---|
| CN | 1071858 | A | 5/1993 |
| CN | 1151091 | A | 6/1997 |

(Continued)

*Primary Examiner* — Mohamad Musleh
(74) *Attorney, Agent, or Firm* — Bachman & Lapointe, P.C.

(57) ABSTRACT

An electromagnetic actuator device has a core unit with a coil device designed to cooperate with armature units displaceably guided relative to the core unit in response to current applied to the coil device, wherein the core unit is designed to cooperate with a plurality of spatially separated plunger units of the armatures so that an electromagnetic interaction takes place with the plurality of plunger units in response to current applied to a coil of the coil device.

11 Claims, 3 Drawing Sheets

(56) References Cited

U.S. PATENT DOCUMENTS

| | | | | |
|---|---|---|---|---|
| 6,472,967 | B1 * | 10/2002 | Muraji | 335/229 |
| 6,768,406 | B1 | 7/2004 | Fiaccabrino | |
| 6,831,535 | B1 * | 12/2004 | Wen et al. | 335/132 |
| 7,741,941 | B2 * | 6/2010 | Buezis et al. | 335/265 |
| 7,843,289 | B1 * | 11/2010 | Raklyar et al. | 335/4 |
| 2004/0051608 | A1 * | 3/2004 | Donce | 335/256 |
| 2006/0049901 | A1 * | 3/2006 | Bottcher et al. | 335/229 |
| 2008/0136569 | A1 * | 6/2008 | Pedersen | 335/205 |
| 2008/0164964 | A1 * | 7/2008 | Nelson | 335/229 |
| 2010/0192885 | A1 | 8/2010 | Golz et al. | |

FOREIGN PATENT DOCUMENTS

| | | | |
|---|---|---|---|
| DE | 102007010156 | A1 * | 9/2008 |
| DE | 102007028600 | A1 | 12/2008 |
| JP | 58003206 | A * | 1/1983 |
| WO | 03052184 | A1 | 6/2003 |
| WO | WO 2009018919 | A1 * | 2/2009 |

* cited by examiner

ELECTROMAGNETIC ACTUATOR DEVICE

BACKGROUND

The present invention relates to an electromagnetic actuator device according to the preamble to the main claim.

Such devices are generally known from prior art, are normally used as bistable actuators for positioning purposes on a combustion engine, for example for camshaft adjustment, and exhibit two or more plunger units, which are moved by energizing the coil means, whether synchronously clockwise or counterclockwise or independently of each other, so as to perform the intended positioning operation.

However, it is precisely within the spatially confined installation context of a combustion engine where it is critical that an actuator device with a plurality of plunger units be given a compact design, wherein known approaches from prior art, specifically two or more adjacent individual actuators with a respective core, coil and plunger unit, can often not be suitably placed. In this regard, German Patent Application 10 2007 028 600 of the applicant describes an approach to arrange adjacent individual actuators next to each other in as close and space-saving a way possible, also with the intention of realizing a distance between the two plunger units necessitated by the application.

While the compactness of the generic technology can be increased in this way, the inherent problem of component and production-related outlay remains, especially with respect to large-scale or mass production.

SUMMARY OF THE INVENTION

Therefore, the object of the present invention is to improve a generic electromagnetic actuator device with a core unit that exhibits a coil means and is designed for interacting with anchor means that actuate at least two plunger units in such a way as to not just improve a compact arrangement (first and foremost with respect to a minimal achievable distance between two plunger units), but optimize such a device with regard to required elements and components, and in terms of manufacturing outlay.

The object is achieved by the electromagnetic actuator device with the features in the main claim; advantageous further developments of the invention are described in the subclaims.

In advantageous manner according to the invention, the core unit is designed in such a way that it can interact with a plurality of plunger units that are spatially spaced apart from each other, wherein the core unit has allocated to it one (and preferably only one) coil or coil unit (coil body), which when energized causes the plurality of plunger units to move in response.

One preferred further development involves configuring the core unit as a single piece, at least so that a leg region (leg pair region) designed to interact with at least two of the plunger units is designed as a single piece. In this case, preferred embodiments call for giving the core unit a yoke or U-shaped configuration, and provide free front or end surfaces of this configuration for interacting with the plunger units.

The geometric realization is here limited neither to a two-dimensional structure, nor to the provision of only two free legs: Rather, it lies within the scope of preferred additional further developments of the invention to repeatedly give the core unit a U-shaped, E-shaped or H-shaped configuration, or spatially twist individual legs against each other (in a third dimension) in such a way that the latter do not lie in a shared plane with a connecting section of the core unit; all of these geometric variants can then be geared toward respective installation preconditions and/or specific functions of the electromagnetic actuator device according to the invention, wherein it is especially favorable for a plunger unit of the anchor means to be situated opposite each leg or each free face of such a leg for purposes of interaction.

Within the framework of preferred further developments of the invention, the coil means exhibit at least one coil extending around a segment of the core unit; while the position or arrangement of this coil can in principle be as desired, and be made dependent on magnetic and/or spatial circumstances, it is favorable according to the further development to provide this coil in a central and/or connecting region between free legs of the core unit.

It is also advantageous within the framework of further developments to provide at least one of the plunger units, in particular where engaged and/or operating with the core unit, with permanent magnet means so as to in this respect enable the realization of a bistable action.

Also provided according to a further development is to design such permanent magnet means in such a way that the desired (if necessary synchronized) motion of the plurality of plunger units can take place in the desired manner: For example, a homopolar arrangement of permanent magnet means on opposing plunger units would lead to an opposite plunger motion with respect to the ends of a U-shaped core unit when energizing a (single) coil on the core unit; by contrast, a heteropolar provision of permanent magnet units would enable an aligned motion of the plunger units.

It is also possible and provided within the framework of further developments of the invention, in particular in the case of plunger units exhibiting permanent magnet units, to additionally provide the core unit with magnetically active flow guiding means in such a way as to magnetically decouple the plunger units from each other, thereby preventing, or at least diminishing, a reciprocal magnetic influence.

While it is advantageous and favorable within the framework of the invention to minimize (ideally reduce to one) the number of required coils of the coil means, the present invention is not limited to this, with it rather being possible within the framework of preferred further developments to provide additional coils and/or windings, for example with the purpose of influencing the behavior of the plunger units as a whole and relative to each other by specifically overlapping and/or displacing fields generated by the coil(s) or winding, in addition to which an additional winding (on an already existing coil or the accompanying coil body) is suitable in a further development for determining the induction-generated and detectable movement and switching states of plunger units and making them accessible for further evaluation.

It is especially suitable to configure the device according to the invention as a bistable actuator, specifically to design at least one of the plunger units in such a way that it assumes a zero current, stable state in both end positions of a movement and switching state. As a consequence, the present invention is then suitable in a special manner for limited installation dimensions and environmental conditions, for example in the area of automobiles and automobile combustion engines, although the present invention not being limited to this purpose.

BRIEF DESCRIPTION OF THE DRAWINGS

Additional advantages, features and details of the invention may be gleaned from the following description of preferred exemplary embodiments as well as from the drawings; the latter show.

DETAILED DESCRIPTION OF THE PREFERRED EMBODIMENT(S)

Figure 1:
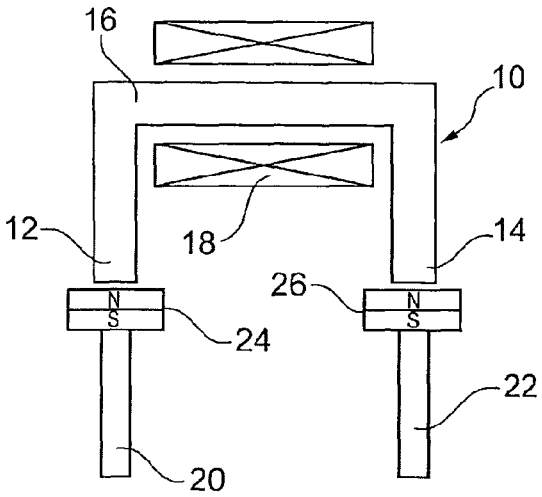
FIG. 1 a diagrammatic concept sketch of the electromagnetic actuator device according to a first, preferred embodiment of the present invention.
Figure 5:
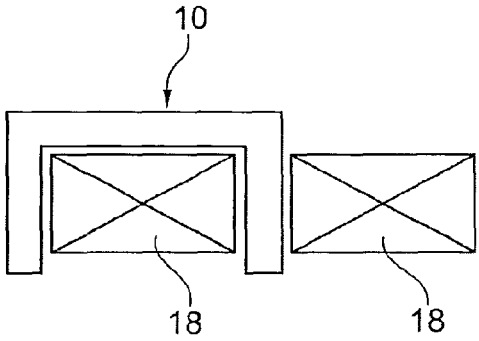
FIG. 3 to FIG. 5 different variants for placing a single coil as the coil means in a position of the core unit given a U-shaped design.
Figure 2:
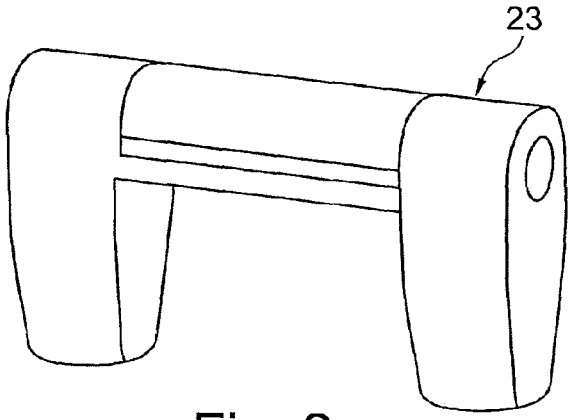
FIG. 2 a perspective view of an example for physically realizing the exemplary embodiment on FIG. 1.
Figure 4:
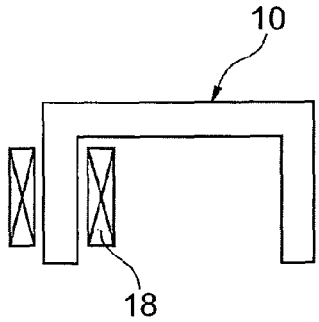

The concept sketch on FIG. 1, see also the three-dimensional representation on FIG. 2, illustrates the basic principle of the invention according to a first embodiment of the invention: The middle connecting region 16 of a U-shaped, bent core element 10 with a pair of free leg ends 12, 14 exhibits a coil unit 18 (held in a coil carrier that is not shown), which is energized in an otherwise known manner.

In response to the energizing, the anchor unit 10 interacts electromagnetically with a pair of plunger units 20, 22 as the anchor means, which each are aligned axially to accompanying leg sections of the core unit 10, and stand axially opposite the leg ends 12 or 14.

In the end region directed toward the core unit 10, the plunger units 20 or 22 each exhibit a permanent magnet unit 24 or 26, which, depending on the polarity of the electromagnetic field generated by energizing the coil unit 16, attracts or repels, and correspondingly moves the movably mounted plunger unit 20 or 22 (in a way not shown) in an axial direction, so as to perform an envisaged (bistable) positioning function at the end of the plunger units 20 or 22 lying opposite the permanent magnet units 24 or 26, for example interacting with a suitable positioning partner in a camshaft adjustment of a combustion engine or similar application.

As evident from FIG. 2, the physical realization of the diagrammatically depicted exemplary embodiment on FIG. 1 in this way generates a very compact and efficient structure, specifically a bracket structure that is easy to manufacture and requires a low component outlay, and can be provided in a simple manner suitably opposite the respective positioning partner. In particular, the housing 23 exemplarily shown on FIG. 1 provides an opportunity not just to accommodate the core and coil unit 10, 18, but also configure a guide for the pair of plunger units.

FIGS. 3 to 6 depict variants of the basic exemplary embodiment on FIG. 1; depending on the positioning (FIG. 3, 4) of the coil unit 18 and/or dimensioning of the coil unit (large winding on FIG. 5), it is possible to suitably influence the field progression along the core unit or in conjunction with the plurality of plunger units, for example in such a way as to specifically generate force or movement asymmetries.

Figure 6:
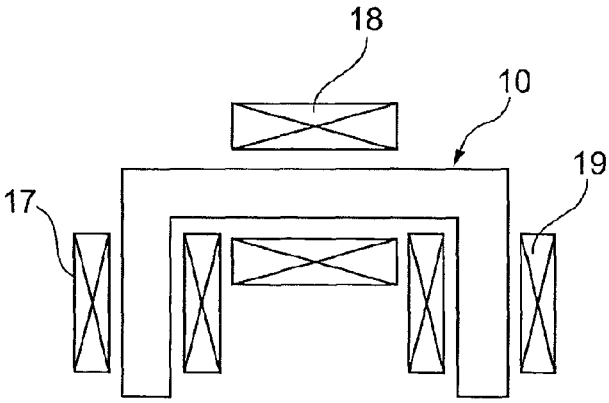
FIG. 6, FIG. 7 other embodiments as variants of the invention with a plurality of coils on a U-shaped bent core element.
Figure 3:
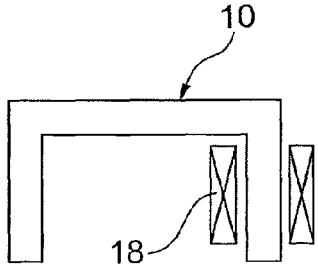
Figure 7:
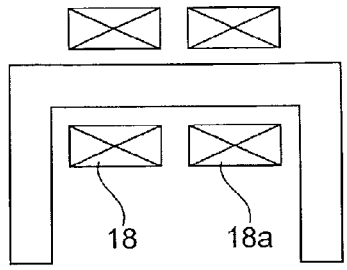

The realizations on FIG. 6, 7 with a plurality of coils 17, 18, 19 and/or windings (if necessary on a shared coil carrier) make it possible on the one hand to create specific field progressions via overlapping, heteropolar or homopolar actuation of the individual coils, so as to potentially enable situational responses. In addition, for example to also substitute a polarity reversal of the coil from the standpoint of circuit design (for an upstream controller), a coil carrier can carry two windings 18, $\mathbf{18}_a$ (FIG. 7), providing the option to energize a respective wire pair, and hence only a part of the coil. It is also possible to use a second, not actively energized coil or winding, so as to detect switching states of the respective actuator device: In their movement relative to the core unit, for example with the permanent magnet units provided at the end, plunger units will thus induce corresponding voltages, which are then applied to the two-terminal of the additional coil for detection and further processing.

Figure 8:
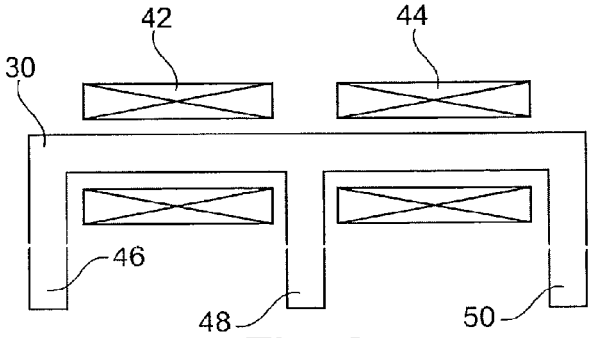
FIG. 8 another variant of the invention with a plurality of coils and E-shaped core element.

FIG. 8 shows another variant; in this case, the core unit 30 is configured (E-shaped with coil units 42, 44 respectively provided in the intermediate space of the three legs) in such a way that the total of three plungers (not shown) lying opposite the respective leg ends 46, 48, 50 can each be individually moved and shifted relative to each other by varying the way in which the coils 42, 44 are wired or energized.

Figure 11:
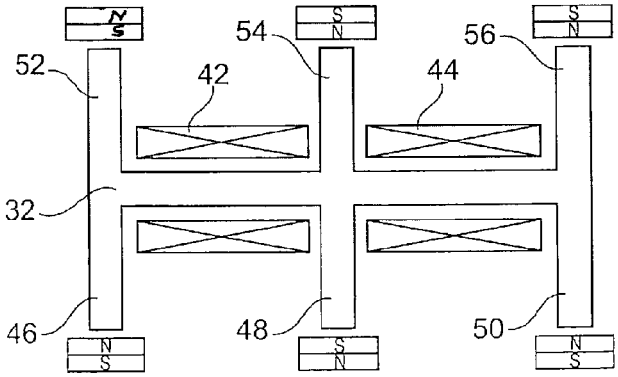
FIG. 11 another variant of the present invention as an embodiment with double-H-shaped core unit.

This principle would now appear to be expandable nearly as desired; as depicted on FIG. 11, 12, for example, a core unit 32 can suitably also be equipped with legs, thereby yielding the double H-shape diagrammatically shown on FIG. 11; additional free legs 52, 54, 56 are only shown diagrammatically opposite the free legs 46, 48, 50; permanent magnets of correspondingly accompanying movable plunger units (not shown) are also only diagrammatically provided here.

Figure 9:
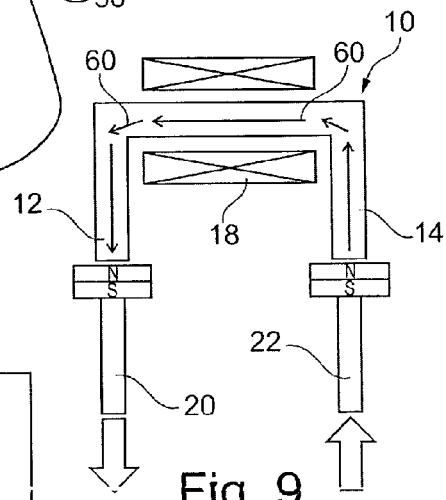
FIG. 9, FIG. 10 diagrammatic views for explaining how the device according to FIG. 1, FIG. 2 interacts with the permanent magnets provided at the plunger units.
Figure 10:
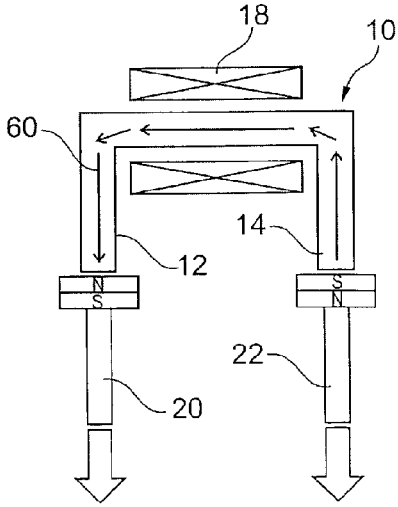

Depending on the positioning or arrangement of the permanent magnets, the desired pattern of movement can be generated as can be explained based on the example of FIG. 9, (according to the basic exemplary embodiment on FIG. 1): FIG. 9 illustrates how permanent magnets 24 or 26 respectively polarized in the same direction lie opposite the free legs 12, 14; the field progression diagrammatically denoted by the arrows 60 thereby yields the downwardly directed movement for the plunger unit 20, and upwardly directed movement for the plunger unit 22. By contrast (see FIG. 10), if the permanent magnet 26 is subjected to a polarity reversal, a shared downward movement arises with arrow lines 60 running in the same direction.

Figure 12:
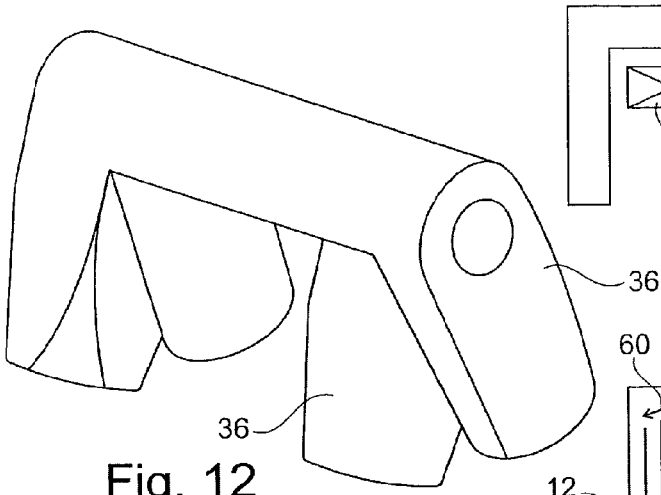
FIG. 12 to FIG. 14 other variants of the invention with three-dimensionally arranged leg ends of a core unit.
Figure 13:
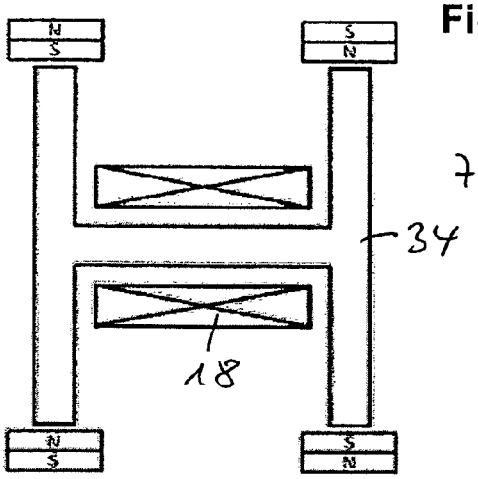
Figure 14:
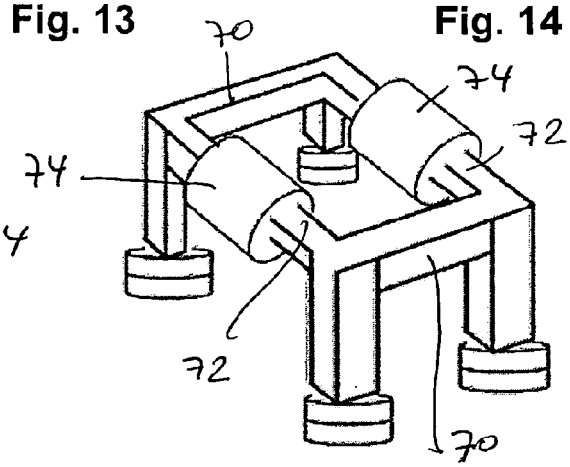
Figure 15:
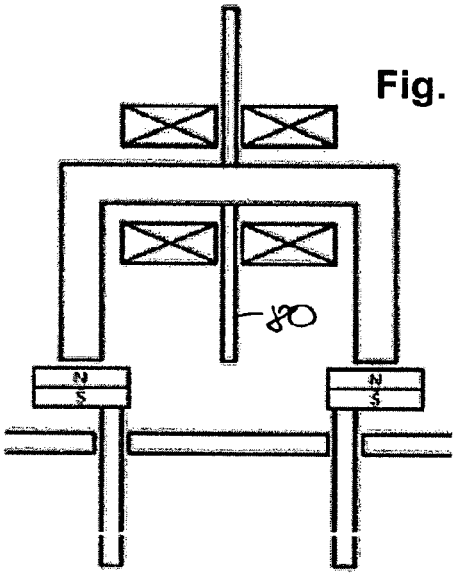
FIG. 15 to FIG. 18 another variant of the invention with flow guiding elements provided between a pair of permanent magnets sitting on plunger units for decoupling the (permanent) magnetic inflow toward each other.
Figure 16:
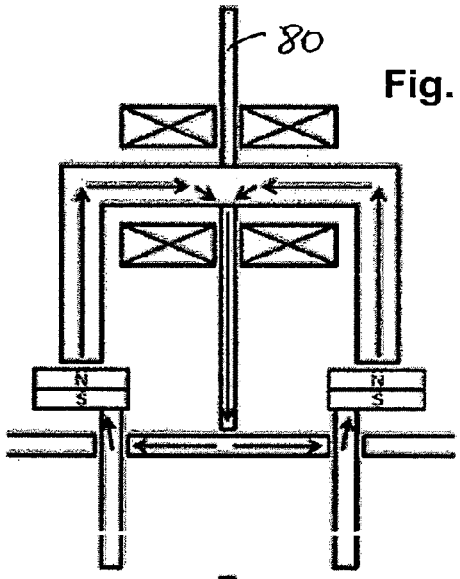
Figure 18:
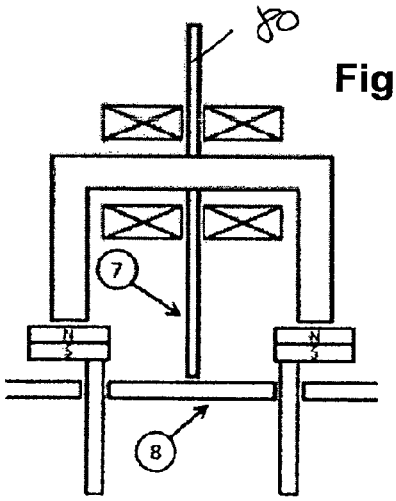

As may be gleaned with reference to FIGS. 12 to 14 and the embodiment sketches contained therein, a three-dimensional arrangement is also possible and encompassed by the invention, i.e., respectively free legs do not have to lie with each other in a shared plane (or with a connecting section of the core unit): For example, the exemplary embodiment on FIG. 12, 13 illustrates that while the core unit assumes an H-shape in a strictly diagrammatic sense, the free legs of a housing 36 form an acute angle relative to each other in the physical realization (FIG. 12), and not a 180° angle.

By contrast, the arrangement on FIG. 14 shows a cuboid geometry of the plunger units, wherein the respectively free legs are joined by a connecting element 70, 72 in the form of a rectangular frame, and coil units 74 are then formed on the longitudinal sections of the frame.

FIGS. 15 to 18 are now used to describe how an additionally inserted flow guiding element 80 resembling a guide disk closes a (permanent) magnetic circuit via the respective permanent magnets, insofar as the permanent magnets are decoupled from each other, thereby suppressing any reciprocal influence.

Figure 17:
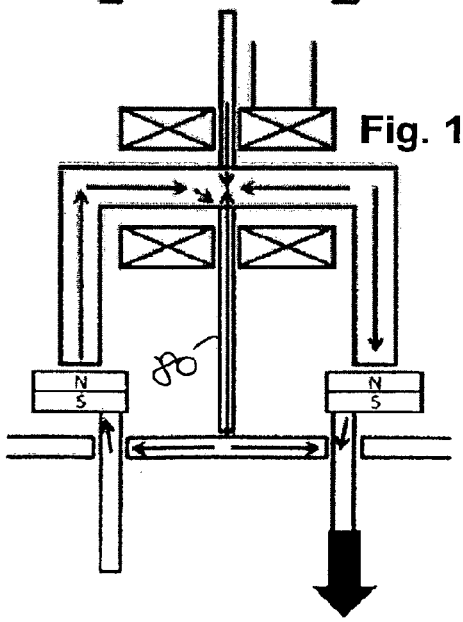

As soon as one of the coils is energized as depicted on FIG. 17, a counterforce to the permanent magnetic circuit is generated (see right region), so that the permanent magnetic field is weakened or neutralized, or the accompanying plunger unit is even repelled.

Such flow guiding elements make it possible in particular to drastically reduce the switching or clock cycles of the present invention by decoupling or preventing a reciprocal influence.

The invention claimed is:

1. An electromagnetic actuator device comprising:

a core unit that has a coil means and is designed for interacting with anchor means movably guided relative to the core unit in response to energizing the coil means;

said core unit having a yoke or U-shaped configuration with a plurality of spaced apart legs connected by a cross member having a length;

each of said spaced apart legs having a longitudinal axis and a free end which is perpendicular to said longitudinal axis;

said anchor means having a plurality of spatially spaced apart and independently movable plunger units which move toward and away from the free ends of said spaced apart legs;

the core unit interacting with said plurality of spatially spaced apart plunger units so that an electromagnetic interaction with the plurality of plunger units takes place in response to energizing a coil of the coil means; and at least one of the plunger units has permanent magnet means designed for interacting with the core unit, and said at least one of the plunger units being independently movable in a direction parallel to said longitudinal axis of at least one of said legs and perpendicular to said length of said cross member and being aligned with said at least one of said legs so as to have an end opposed to said free end of said at least one of said legs.

2. The device according to claim 1, wherein the core unit is designed as a single piece.

3. The device according to claim 1, wherein the core unit repeatedly is one of U-shaped, E-shaped and H-shaped, and is designed to interact with a said plurality of plunger units.

4. The device according to claim 1, wherein said plurality of spaced apart legs comprises at least two free legs which extend in such a way that the at least two free legs do not lie in a shared plane with a connecting section of the legs.

5. The device according to claim 1, wherein the coil means has at least one coil extending around a section of the core unit.

6. The device according to claim 1, wherein the plunger units of the anchor means are designed in such a way through a homopolar or heteropolar provision of permanent magnet means that two plunger units can be moved in the same or opposite directions when energizing a coil of the coil means.

7. The device according to claim 1, further comprising magnetic flow guiding means provided between at least two of the plurality of plunger units in such a way as to reduce a reciprocal magnetic influencing of the plunger units.

8. The device according to claim 1, wherein the coil means has an additional winding wired to detect one of movement and switching state of at least one of the plunger units.

9. The device according to claim 1, wherein the device comprises a bistable actuator configured in such a way as to keep at least one of the plurality of plunger units in a respective end position under zero current.

10. The device according to claim 1, wherein the device is designed as a positioning unit for a combustion engine.

11. The device according to claim 1, wherein the device is a positioning unit for camshaft adjustment.

* * * * *